US008172323B2

(12) United States Patent
Masunaga

(10) Patent No.: US 8,172,323 B2
(45) Date of Patent: May 8, 2012

(54) LOCKING DEVICE FOR A MOVABLE MEMBER IN A CHAIR

(75) Inventor: Hiroshi Masunaga, Yokohama (JP)

(73) Assignee: Okamura Corporation (JP)

( * ) Notice: Subject to any disclaimer, the term of this patent is extended or adjusted under 35 U.S.C. 154(b) by 237 days.

(21) Appl. No.: 12/528,717

(22) PCT Filed: Feb. 21, 2008

(86) PCT No.: PCT/JP2008/052975

§ 371 (c)(1),
(2), (4) Date: Aug. 26, 2009

(87) PCT Pub. No.: WO2008/105314

PCT Pub. Date: Sep. 4, 2008

(65) Prior Publication Data

US 2010/0109402 A1 May 6, 2010

(30) Foreign Application Priority Data

Feb. 27, 2007 (JP) ..... 2007-046810
Feb. 27, 2007 (JP) ..... 2007-046812

(51) Int. Cl.
*A47C 1/024* (2006.01)

(52) U.S. Cl. ..... 297/301.7; 297/364

(58) Field of Classification Search ..... 297/300.2, 297/300.6, 300.7, 300.8, 301.5, 301.6, 301.7, 297/302.5, 302.6, 302.7, 364, 365
See application file for complete search history.

(56) References Cited

U.S. PATENT DOCUMENTS 3,111,343 A * 11/1963 Pearson ..... 297/303.3
4,125,288 A * 11/1978 Hunter ..... 297/301.3
5,282,670 A * 2/1994 Karsten et al. ..... 297/370
5,971,481 A * 10/1999 Emmenegger et al. .... 297/300.8
6,033,020 A * 3/2000 Ito ..... 297/302.4

(Continued)

FOREIGN PATENT DOCUMENTS

JP 49-030744 U 3/1974

(Continued)

OTHER PUBLICATIONS

International Search Report dated Mar. 25, 2008, issued in corresponding international application No. PCT/JP2008/052975.

*Primary Examiner* — David Dunn
*Assistant Examiner* — David E Allred
(74) *Attorney, Agent, or Firm* — Ostrolenk Faber LLP

(57) ABSTRACT

An easily operable lock device for a movable member of a chair, the lock device being adapted such that a person sitting on the chair can select lock or unlock position by operating operation means with a load, such as the weight of the person, acting on the movable member and, when the load is removed after the selection of the lock or unlock position, lock or unlock operation is executed. A lock pin provided at a spring receiving member functioning as a movable member, is selectively engaged with and disengaged from engagement holes formed in a reinforcement plate functioning as a support member. The lock device has biasing means for biasing the lock pin toward the lock position when an operation member moved by the operation means is set at a lock reservation position and biasing the lock pin toward the unlock position when the operation member is set at an unlock reservation position.

2 Claims, 11 Drawing Sheets

U.S. PATENT DOCUMENTS

| | | | | |
|---|---|---|---|---|
| 6,213,552 | B1 * | 4/2001 | Miotto | 297/300.5 |
| 6,598,936 | B1 * | 7/2003 | Klein | 297/301.2 |
| 6,742,843 | B2 * | 6/2004 | Golynsky | 297/363 |
| 6,916,067 | B2 * | 7/2005 | Liu | 297/300.8 |
| 7,278,685 | B1 * | 10/2007 | Lin | 297/301.7 |
| 7,293,832 | B2 * | 11/2007 | Huang | 297/300.8 |
| 2005/0077766 | A1 * | 4/2005 | Chen | 297/300.8 |
| 2005/0077767 | A1 * | 4/2005 | Liu | 297/300.8 |

FOREIGN PATENT DOCUMENTS

| | | | |
|---|---|---|---|
| JP | 58-146109 | U | 10/1983 |
| JP | 59-44364 | | 3/1984 |
| JP | 11-169251 | A | 6/1999 |
| JP | 11-169255 | A | 6/1999 |
| JP | 2000-139602 | A | 5/2000 |
| JP | 2001-29162 | A | 2/2001 |
| JP | 2005-163966 | | 6/2005 |

* cited by examiner

LOCKING DEVICE FOR A MOVABLE MEMBER IN A CHAIR

CROSS REFERENCE TO RELATED APPLICATIONS

The present application is a 35 U.S.C. §371 National Phase conversion of PCT/JP2008/052975, filed Feb. 21, 2008, which claims benefit of Japanese Application Nos. 2007-046810, filed Feb. 27, 2007, and 2007-046812, filed Feb. 27, 2007, the disclosures of which are incorporated herein by reference. The PCT International Application was published in the Japanese language.

BACKGROUND OF THE INVENTION

The present invention relates to a locking device for locking a movable member such as the backrest or a seat, In a locking device in JP59-44364U, the front part of the seat is pivotally mounted to the front part of a support base, and the rear part of the seat is urged forward and upward by a spring. In the adjusting metal tool on the lower surface of the rear part of the seat, a plurality of engagement holes communicates with one another via narrower communicating holes to form an adjusting hole. The support base comprises an operating rod which has a larger-diameter portion which passes through the engagement hole, but does not pass through the communicating hole, and a smaller-diameter portion which passes through the smaller-diameter hole to move axially. The smaller-diameter portion fits in the adjusting hole to allow the seat to be adjusted freely in an angle. The smaller-diameter portion is shifted sideward from the adjusting hole to allow the larger-diameter portion to fit in the selected engagement hole, so that the seat is locked at a tilted position determined by the selected engagement hole.

In a conventional chair, an elevating device for the seat or an operating lever for operating a tilting device of the backrest is mounted to the seat, a support base for the backrest, backrest frame or a support member on the lower surface of the seat.

For example, JP2005-163966A discloses the mounting structure in which the end of an operating lever is bent like a crank which actuates a gas spring for urging the backrest to stand up. The shaft of the operating lever is held by a holding tool screwed to the backrest frame.

However, in the locking device in JP59-44364U, an operating rod is loaded by the weight of the occupant who sits on the chair, so that the operating rod is not moved. To move the operating rod, it is necessary for the occupant to leave the seat or to stand up thereby causing poor operativity.

In JP2005-163966A, in order to mount the operating lever, it is necessary to fix the holding metal tool to the support member, which is complicated and needs time. The number of parts is increased.

SUMMARY OF THE INVENTION

In view of the disadvantages in the prior art, it is an object of the invention to provide a locking device for a movable member in a chair in which while the movable member is loaded by the weight of an occupant, an operating portion is operated to shift locking to unlocking and vice versa when it is unloaded.

It is an object of the invention to provide a locking device for a movable member in a chair, in which an operating lever is mounted to a support member without use of screws and is mounted easily and securely with the reduced number of parts.

BEST MODE FOR CARRYING OUT THE INVENTION

Figure 1:
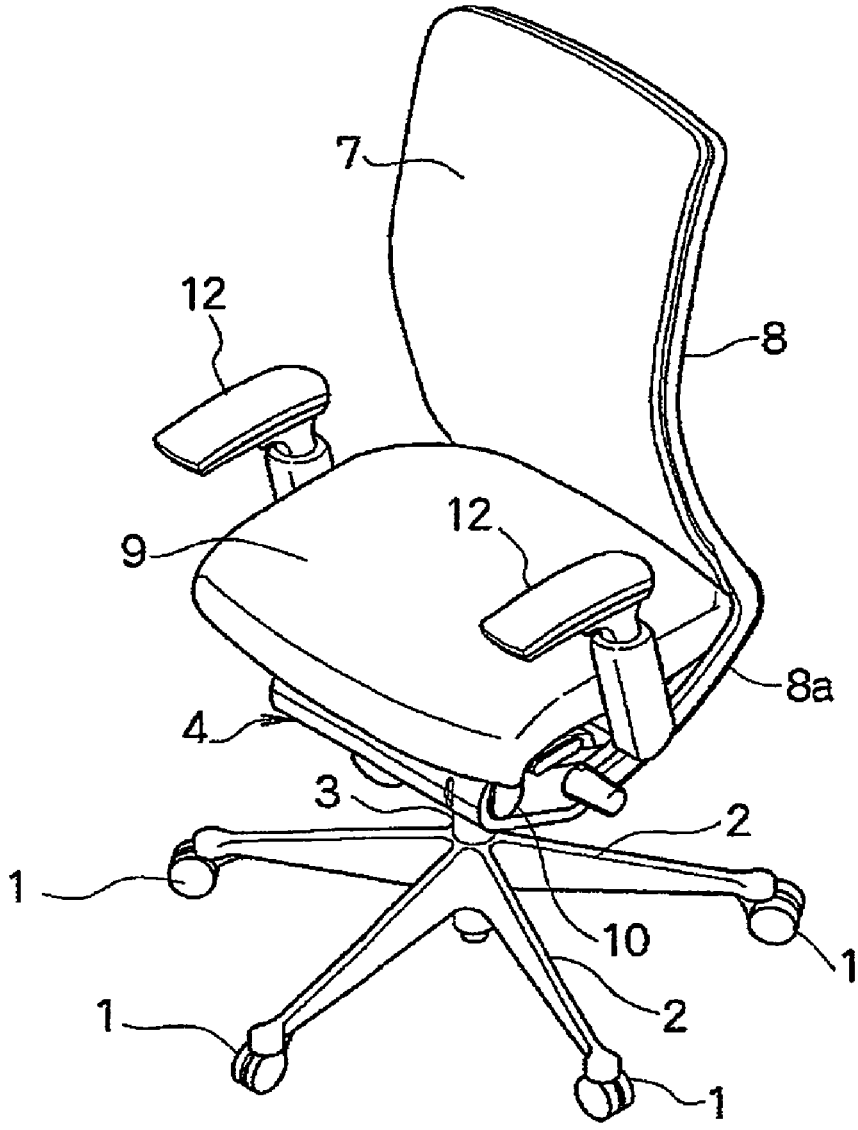
FIG. 1 is a perspective view of a chair comprising the first embodiment according to the present invention.
Figure 2:
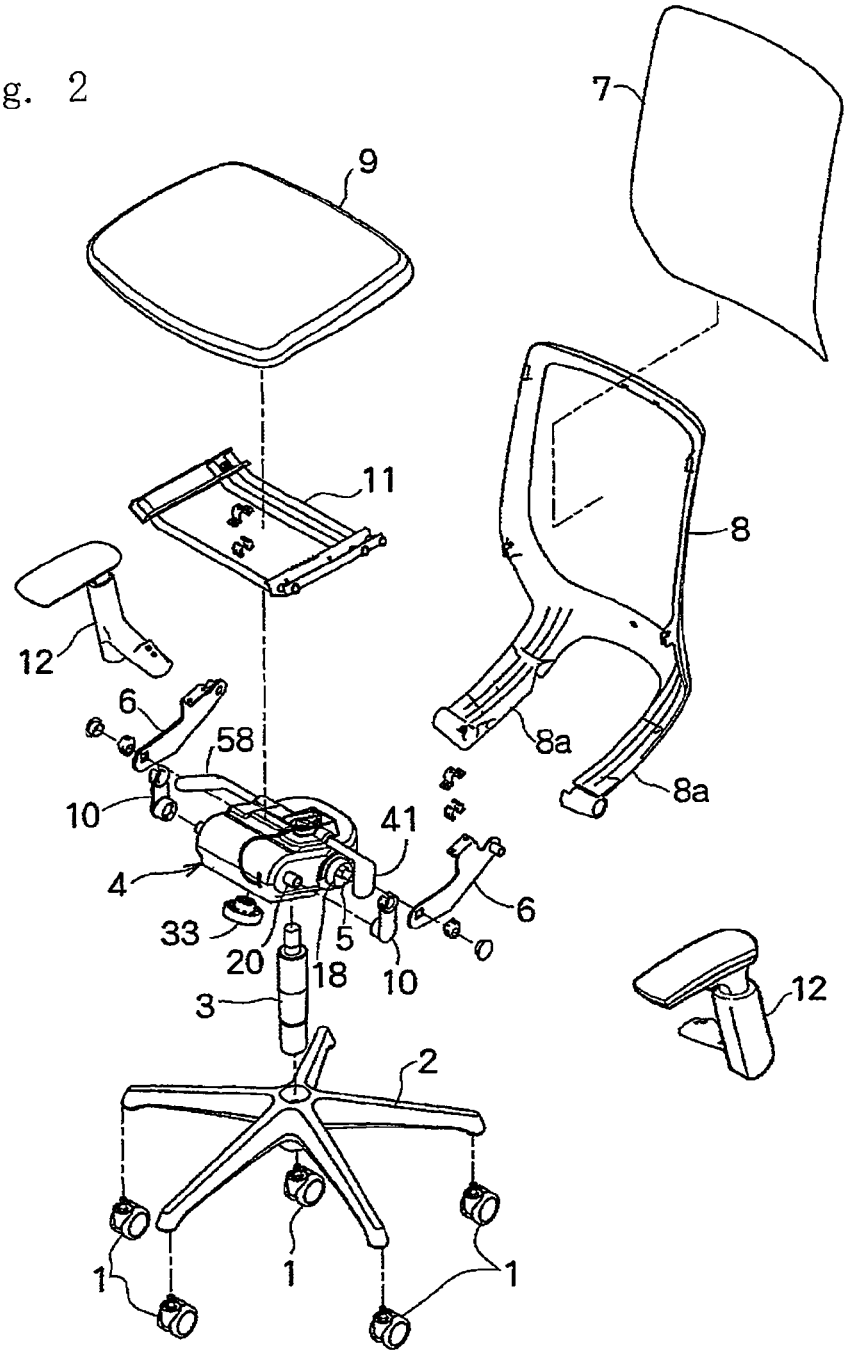
FIG. 2 is an exploded perspective view thereof.

FIG. 1 is a front perspective view of a chair comprising the first embodiment of a locking device according to the present invention, and FIG. 2 is an exploded perspective view thereof.

The chair comprises a telescopic column 3 at the center of five radial legs 2 each of which has a caster 1 at the end; a support base 4 at the upper end of the column 3; a pivot shaft 5 which passes through the support base 4; a pair of brackets 6,6 each fixed to each end of the pivot shaft 5; a backrest frame 8 which supports the backrest 7 and connects the pivot shaft 5 and the brackets 6 to a pair of front rod portions 8*a*,8*a* extending from the lower end of the backrest frame 8 to turn together around the support base 4; a seat frame 11 coupled to the front part of the support base 4 with a pair of link levers 10,10 to move rearward and downward of the support base 4 with rearward tilting of the backrest frame 8; and armrests 12,12 at each side of a seat 9.

Figure 3:
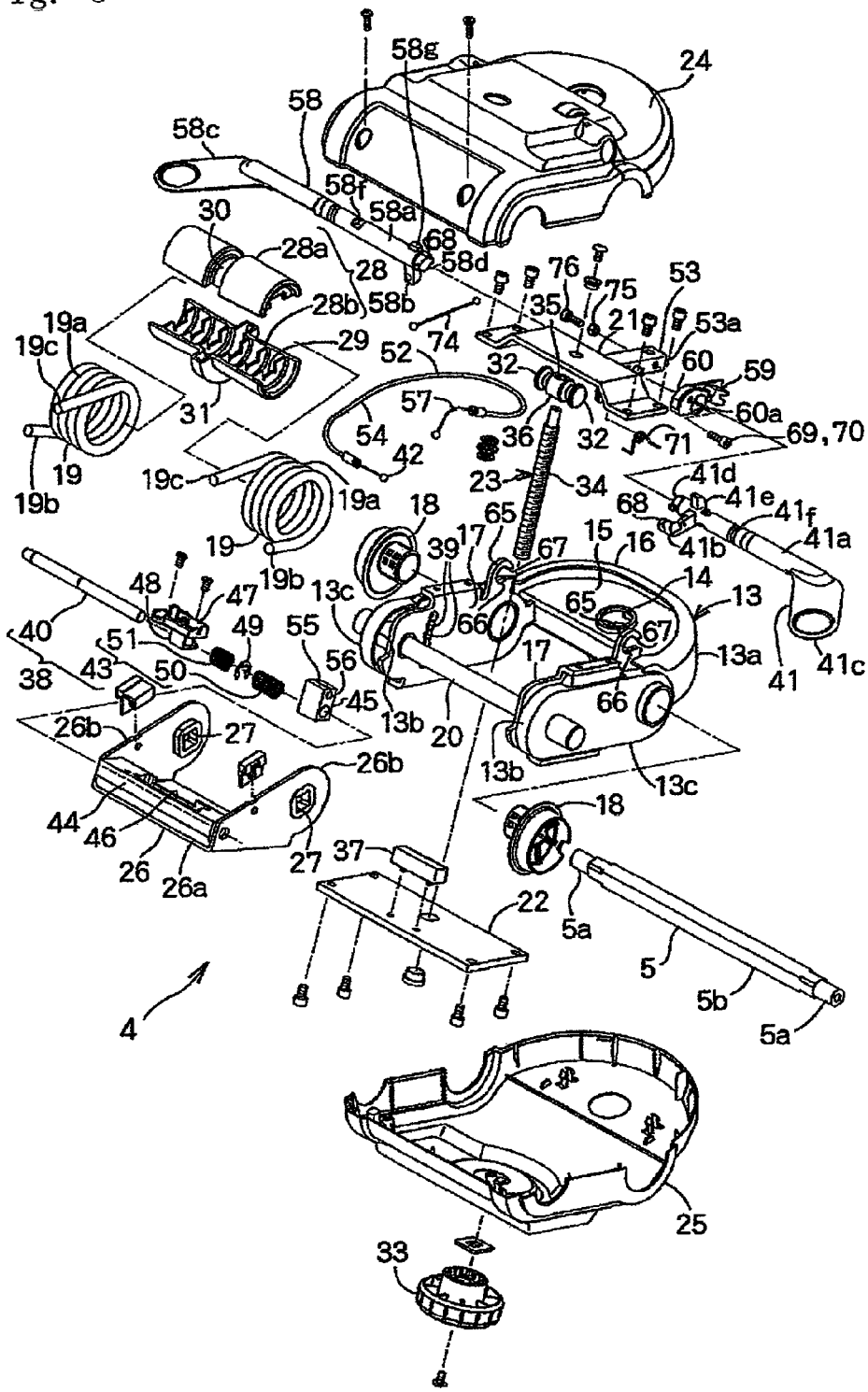
FIG. 3 is an exploded perspective view of a support base.
Figure 4:
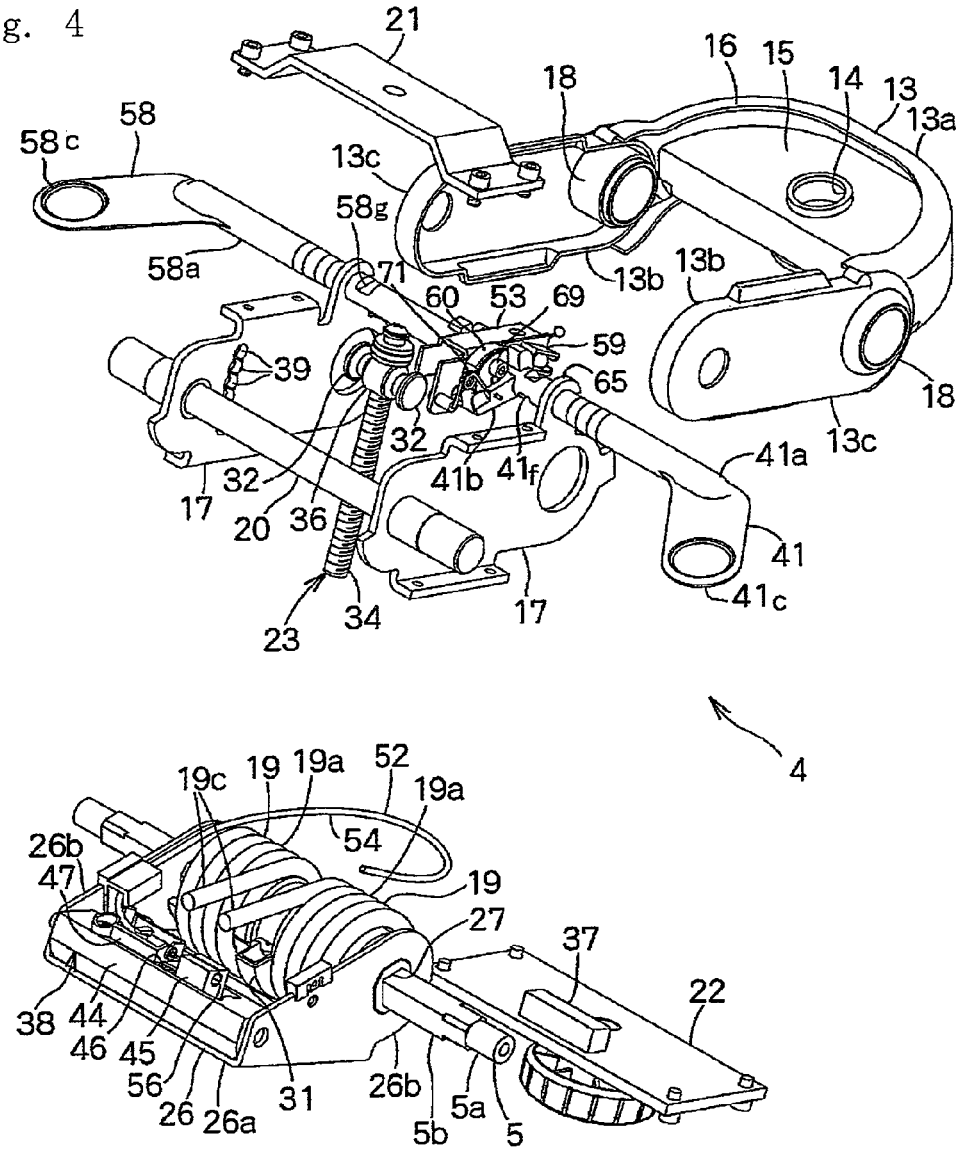
FIG. 4 is an exploded perspective view in which part of the support base is assembled.
Figure 5:
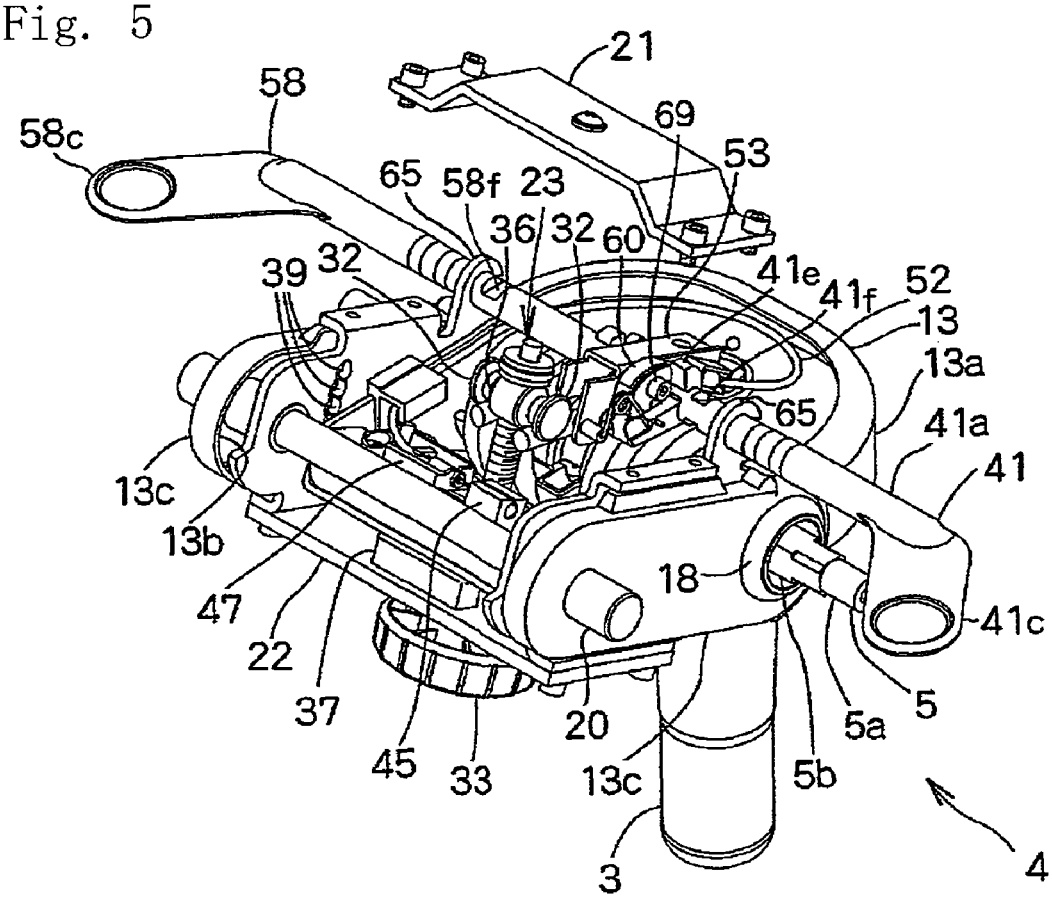
FIG. 5 is an exploded perspective view in which most parts of the support base are assembled.

FIGS. 3-5 are exploded perspective views showing the internal structure of the support base 4 which comprises a U-like support frame 13 which comprises a base portion 13*a* mounted to the upper end of the column 3 and a pair of arms 13*c*,13*c* extending forward from the base portion 13*a* and comprising an inwardly bent edge 13*b*.

The base portion 13*a* comprises a horizontal plate 15 having a through hole 14 in which the upper end of the column 3 fits. To the horizontal plate 15 is fixed an outer circumferential frame 16 with which the arms 13*c*,13*c* are formed.

A reinforcing plate 17 is fixed on the inner surface of each of the arms 13*c*,13*c* of the support frame 13 to form a hollow box thereby improving strength to avoid a large thickness or expensive materials.

At the rear part of the arm 13*c* and the reinforcing plate 17, a bearing tube 18 is provided. In the bearing tubes 18,18, the pivot shaft 5 is pivotally mounted. On the pivot shaft 5, a pair of torsion springs 19,19 is wound to force the backrest 7 to stand up.

Through the arms 13*c* and the reinforcing plates 17, there is provided an auxiliary shaft 20 in parallel with the pivot shaft 5 to pivotally support the lower part of the link levers 10,10 for supporting the front part of the seat 9.

Between the arms 13*c* and 13*c* of the support frame 13 and between the reinforcing plates 17 and 17, there are provided an upper connecting plate 21 and a lower connecting plate 22 through which a force adjuster 23 for the torsion springs 19,19 passes.

The support frame 13 is like U and the reinforcing plates 17,17 are mounted on the arms 13*c*,13*c*. Therefore, the torsion springs 19,19 and the force adjuster 23 can be mounted not only from the above but also from the below and front thereby improving assembling efficiency and strength of the support base 4.

The reinforcing plates 17,17, the torsion springs 19,19, the force adjuster 23, the upper and lower connecting plates 21,22 and parts within the support base 4 (described later) mounted to the support frame 13 are covered with an upper cover 24 and a lower cover 25 improving appearance of the support base 4.

A backrest tilting device in the support base 4 will be described.

The pivot shaft 5 comprises circular parts 5*a*,5*a* at the ends and a rectangular part 5*b* between the circular parts 5*a* and 5*a*. The rectangular portion 5*b* between the reinforcing plates 17 and 17 pass through rectangular holes 27,27 in side portions 26*b*,26*b* standing from a spring receiving portion 26*a* of a spring-receiving member 26 to allow the spring-receiving member 26 to rotate together with the pivot shaft 5 and the backrest 7.

The torsion springs 19,19 are symmetrical to each other. A winding portion 19*a* comprises a first arm 19*b* at the outer end and a second arm 19*c* at the inner end.

Figure 6:
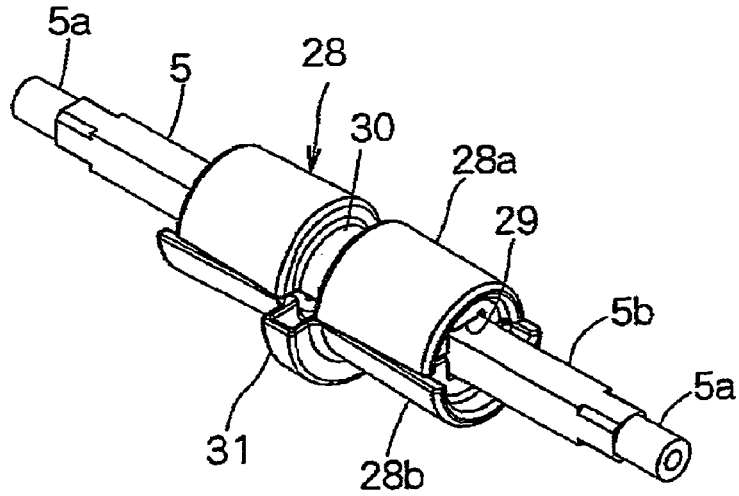
FIG. 6 is a perspective view when a pivot shaft is covered with a guide tube.
Figure 7:
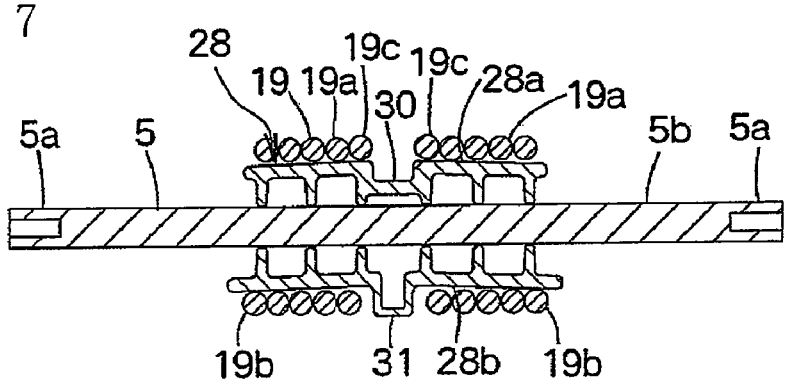
FIG. 7 is a front elevational view thereof.

In FIGS. 6 and 7, the rectangular portion 5 between the side portions 26*b* and 26*b* of the spring-receiving member 26 passes through a rectangular hole 29 in a guide tube 28 fitting over the winding portions 19*a* of the two torsion springs 19,19.

The guide tube 28 is divided into an upper half 28*a* and a lower half 28*b*. A semicircular groove 30 is formed in the outer circumferential surface in the middle of the upper half 28*a* and a larger-diameter rim 31 is provided on the outer circumferential surface in the middle of the lower half 28*b*.

The outer end of the lower half 28*b* which is in contact with the first arm 19*b* of the torsion spring 19 and the inner end of the upper half 28*a* which is in contact with the second arm 19*c* are the largest diameter. The outer circumferential surface of the upper half 28*a* tapers or gradually gets smaller outward from the largest-diameter portion, while the outer circumferential surface of the lower half 28*b* tapers or gradually gets smaller inward. It may be formed stepwise instead of tapering.

Figure 8:
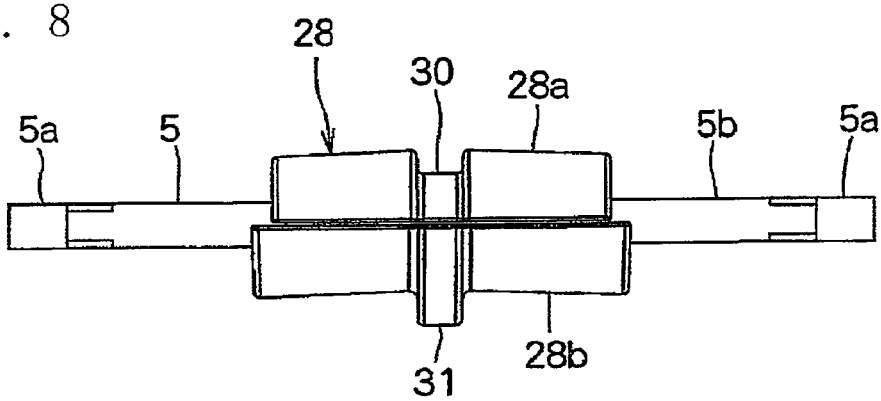
FIG. 8 is a vertical sectional front view thereof.

In FIG. 8, the first arm 19*b* and the second arm 19*c* of each of the torsion springs 19 are always in contact with the outer circumferential surface of the guide tube 28 and the winding portion 19*a* gradually gets larger in diameter to form a wedge space between the inner surface of the winding portion 19*a* of the torsion spring 19 and the outer circumferential surface of the guide tube 28 thereby allowing compression in diameter when the torsion spring 19 is wound over.

Even if the upper and lower arms 19*b*,19*c* of the torsion spring 19 extend in the same direction, they are always guided in contact with the guide tube 28, so that the torsion spring 19 is stably supported without twisting up and down or swaying, and stretched and shrunk along the tapered upper and lower halves 28*a*,28*b* of the guide tube 28. Thus, expected reaction force is obtained.

Both of the first arm 19*b* and the second arm 19*c* extend in the same direction from the winding portion 19*a*, so that the torsion spring 19 itself and part which houses it gets smaller in size in a forward and rearward direction. Thus, more compact device can be produced.

The first arm 19*b* of each of the torsion springs 19,19 is in contact with the upper part of the spring receiving portion 26*a*, and the second arm 19*c* is in contact with the lower surface of a spring-supporting member 32 of the force adjuster 23.

The force adjuster 23 is rotatably mounted between the upper connecting plate 21 and the lower connecting plate 22, and comprises a threaded rod 34 provided almost vertically and rotated with a handle 33 under the lower connecting plate 22; an elevating piece 36 having a threaded bore 35 which engages with the threaded rod 34; and the spring-supporting members 32,32 pivotally mounted on each side of the elevating piece 36 like a roller.

When it is not necessary to adjust the force of the torsion springs 19,19, the spring-supporting members 32,32 may be mounted to the upper end of a pulling rod (not shown) which is mounted at the lower end to the lower connecting plate 22 instead of the threaded rod 34.

The spring-receiving member 26 is urged downward by the torsion springs 19,19 and is usually in contact with a stopper 37 on the upper surface of the lower connecting plate 22 to make the backrest 7 upright.

From this situation, an occupant presses the backrest 7 rearward, so that the backrest 7 is tilted rearward together with the pivot shaft 5 and the spring-receiving member 26 around the pivot shaft 5 against the force of the torsion springs 19,19. The force of the torsion springs 19,19 acts as returning force for moving the backrest 7 to the upright position.

Returning force can be adjusted by the force adjuster 23.

When the elevating piece 36 is lowered by turning the threaded rod 34 with the handle 33, the torsion springs 19,19 are synchronously wound to increase the force for making the backrest 7 upright, while the elevating piece 36 is raised, the torsion springs 19,19 are synchronously loosened to decrease the force for making the backrest 7 upright.

Then, a locking device 38 for locking the backrest 7 stepwise at a desired angle of inclination will be described in detail.

In FIGS. 3, 5 and 9, in the locking device 38, a plurality of engagement holes 39 is formed in the left reinforcing plate 17 of the support base 4 like an arc around the pivot shaft 5 in a moving direction of the spring-receiving member 26 as movable member. A lock pin 40 which selectively engages in any one of the engagement holes 39 is movable between a locked position in FIG. 9C where it engages in any one of the engagement holes 39 and an unlocking position in FIG. 9A where it disengages from any one of the engagement holes 39. A wire end 42 moved with an operating lever 4 is movable between a pre-locking position in FIGS. 9B and 9C and an pre-unlocking position in FIGS. 9A and 9D. When the wire end 42 is in the pre-locking position, the lock pin 40 is urged toward the locked position by an urging unit 43 on the spring receiving portion 26*a* of the spring-receiving member 26.

The lock pin 40 is slidingly disposed in a rectangular case 44 on the spring-receiving member 26, and the left end passes through the left side portion 26*b*. A slider 45 which fits over the lock pin 40 close to the end of the lock pin 40 projects from the case 44 and slides in an elongate groove 46 on the case 44.

A tube holder 47 is fixed to the left end of the elongate groove 46 on the case, and a spring-receiving portion 48 which projects from the lower surface of the tube holder 47 projects in the casing 44 via the elongate groove 46.

A larger-diameter rim 49 made of E ring is provided in the middle of the lock pin 40. Between the larger-diameter rim 49 and the slider 45, a compression spring 50 is provided as the first urging unit on the lock pin 40 and acts as the first urging unit for urging the lock pin 40 toward the locked position when the wire end 42 is in the pre-locking position. Between the larger-diameter rim 49 and the spring-receiving portion 48, a compression spring 51 is provided on the lock pin 40 as the second urging unit for urging the lock pin 40 toward the unlocking position when the wire end 42 is in the pre-unlocking position.

The spring constant of the compression spring 50 is larger than that of the compression spring 51, and the compression springs 50 and 51 form the urging unit 43.

The operating lever 41 is connected to the wire end 42 via a Bowden cable 52.

The Bowden cable 52 comprises a flexible outer tube 54 one end of which is mounted to a tube holder 59 to which an operating shaft 41*a* of an operating lever 41 is pivotally mounted, the other end of the outer tube 54 being mounted to the tube holder 47; and a wire 57 which passes through the outer tube 54. One end of the wire 57 pulled from one end of the outer tube 54 is guided along the arc-shaped outer circumferential surface of a wire guide 60 integrally formed with the tube holder 59 and mounted to the end of the first arm 41*b* projecting from a shaft 41*a* of the operating lever 41. The other end of the wire 57 pulled from the other end of the outer tube 54 in parallel with motion of the lock pin 40 is mounted to the wire end 42 in the hole 56 of the slider 45 via a slit 55 on the slider 45.

A bearing member 53 is a U-shape and fixed to the lower surface of the upper connecting plate 21.

Via the Bowden cable 52, the operating lever 21 is connected to the wire end 42. Thus, when the operating lever 41 is in the unlocking position, the wire end 42 is in the pre-unlocking position and is moved to the pre-locking position when the operating lever 41 is turned to the locked position.

Then, the function of the locking device will be described.

Figure 9A:
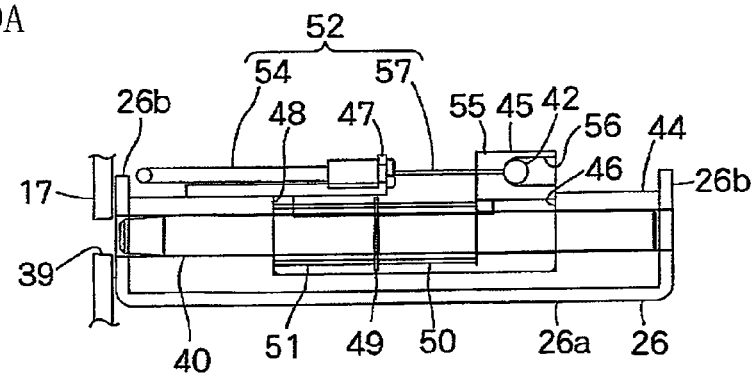
FIGS. 9A-9D are views showing different states of a locking device.
Figure 9B:
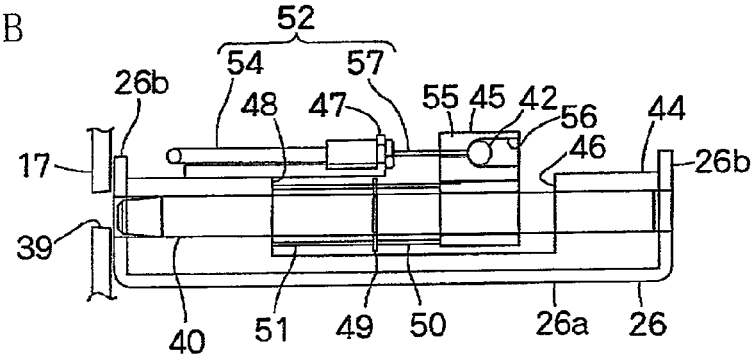

When the operating lever 41 is in the unlocking position, the wire end 42 is in the pre-unlocking position in FIG. 9A where both of the two compression springs 51,50 are stretched, and the lock pin 40 is in the unlocking position where it leaves the engagement hole 39.

In the situation, when the occupant presses the backrest 7 rearward, the backrest 7 is freely tilted together with the pivot shaft 5 and the spring-receiving member 26 around the pivot shaft 5 against the force of the torsion springs 19,19. When pressing force is released from the backrest 7, the backrest 7 is returned to the initial upright position by the torsion springs 19,19.

From this situation, after the backrest 7 is tilted to a desired position, the operating lever 41 is switched to the locked position and the wire end 42 is moved to the pre-locking position. Thus, the slider 45 is moved to the left, the compression spring 50 is compressed and the lock pin 40 is urged toward the left.

Figure 9C:
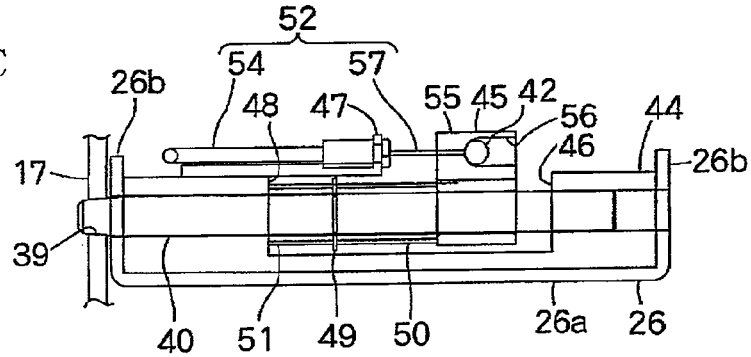

Then, if the lock pin 40 corresponds to any one of the engagement holes 39, the lock pin 40 puts in the engagement hole 39 immediately to the locked position in FIG. 9C. If the lock pin 40 does not correspond to any one of the engagement holes 3, the end is in contact with the inner side surface of the reinforcing plate 17 and the compression spring 50 remains compressed in FIG. 9B.

Thereafter, when the backrest 7 is slightly tilted forward or backward, the compression spring 50 is stretched and the compression spring 51 is contracted, so that the lock pin 40 is put in the closest engagement hole 39 to cause the locked position in FIG. 9C where the backrest 7 is locked.

Figure 9D:
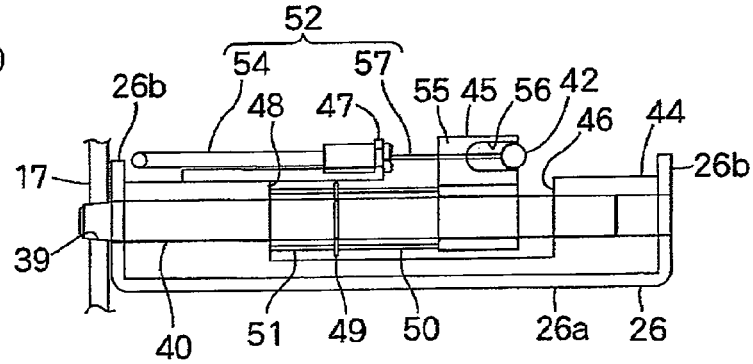

The operating lever 41 is shifted from the locked position to the unlocking position while the occupant is reclined on the backrest 7, so that the wire end 42 is moved to the pre-unlocking position in FIG. 9D. Since the backrest 7 is loaded, the end of the lock pin 40 cannot leave the engagement hole 39 and is held in the locked position.

The compression spring 51 remains contracted, while the compression spring 50 stretches to almost non-loaded state to push the slider 45 rightward slightly. The slider 45 stops as shown in FIG. 9D, and only the wire end 42 leaves the hole 56. If friction between the wire end 42 and the inner surface of the hole 56 is large, the slider 45 moves with the wire end 42 rightward and may leave the compression spring 50. Both may be admitted.

When the backrest 7 is slightly tilted forward or backward, the compression spring 51 stretches and the lock pin 40 leaves the engagement hole 39 to return to the initial unlocking position in FIG. 9A.

In FIGS. 3 and 5, above the support base 4, there is provided an operating lever 58 for adjusting a height of the support base 4 symmetrically with the operating lever 41.

Then, in FIGS. 3-5 and FIGS. 10-14, the structure for mounting the operating levers 41,58 to the support base 4 will be described.

A smaller-diameter axial hole 61 is formed through each of the side plates 53*a*,53*a* of the bearing member 53 of the support base 4. Rectangular recesses 62,62 are formed in the axial hole 61. The right side plate 53*a* bears the inner end of the operating lever 41, and the left side plate 53*a* bears the inner end of the operating lever 58.

A threaded bore 63 is formed in front of the axial hole 61, and a positioning hole 64 is formed at the back of the axial hole 61.

At the upper rear part of each of the reinforcing plates 17,17, a bearing portion 65 has a larger-diameter axial hole 66 larger in diameter than the smaller-diameter axial hole 61 and an opening 67 having a width smaller than the diameter of the larger-diameter axial hole 66.

The smaller-diameter axial hole 61 is axially aligned with the larger-diameter axial hole 66 and spaced by a distance D1.

Figure 10:
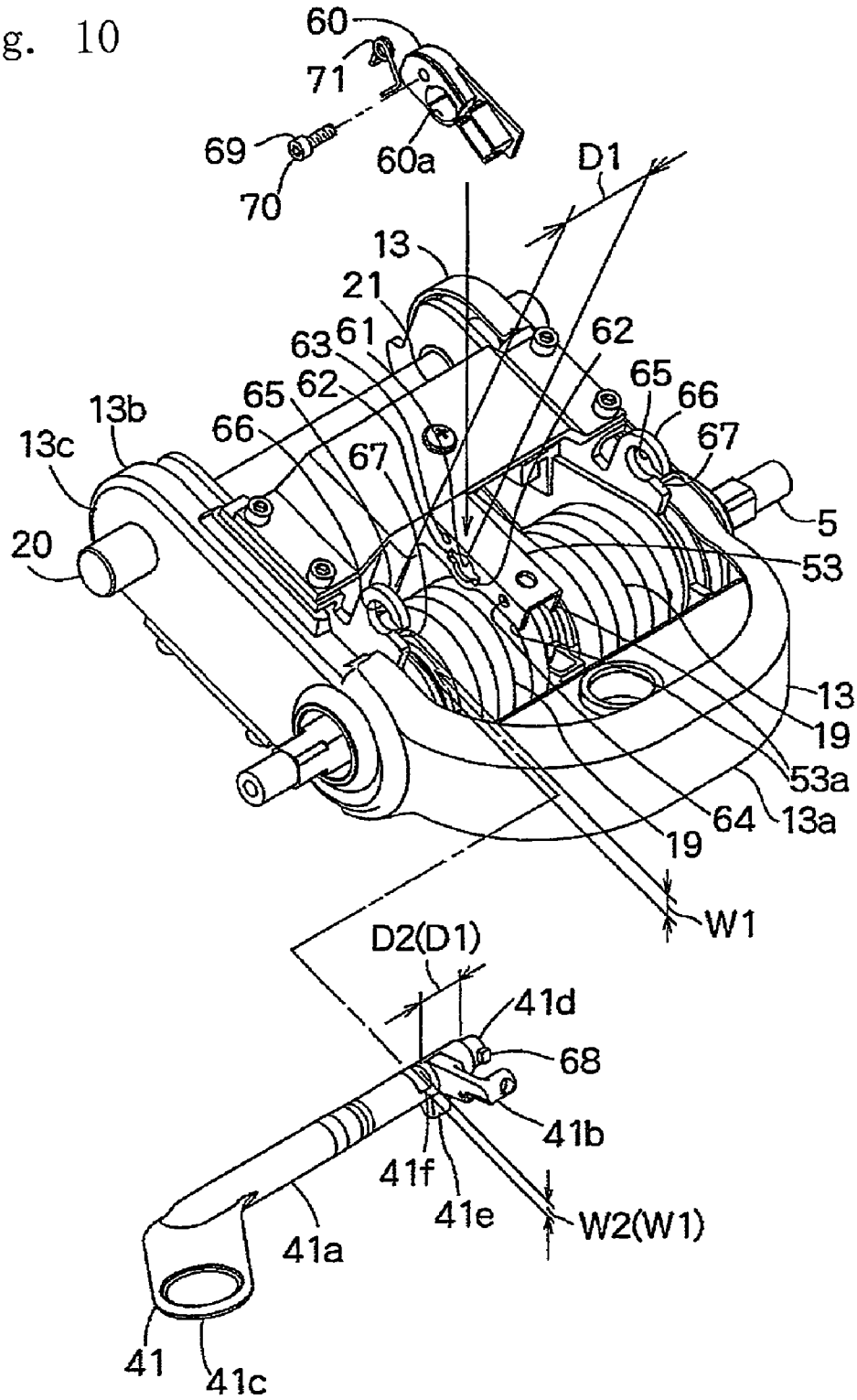
FIG. 10 is a rear exploded perspective view of a support base showing the mounting structure of an operating lever.
Figure 11:
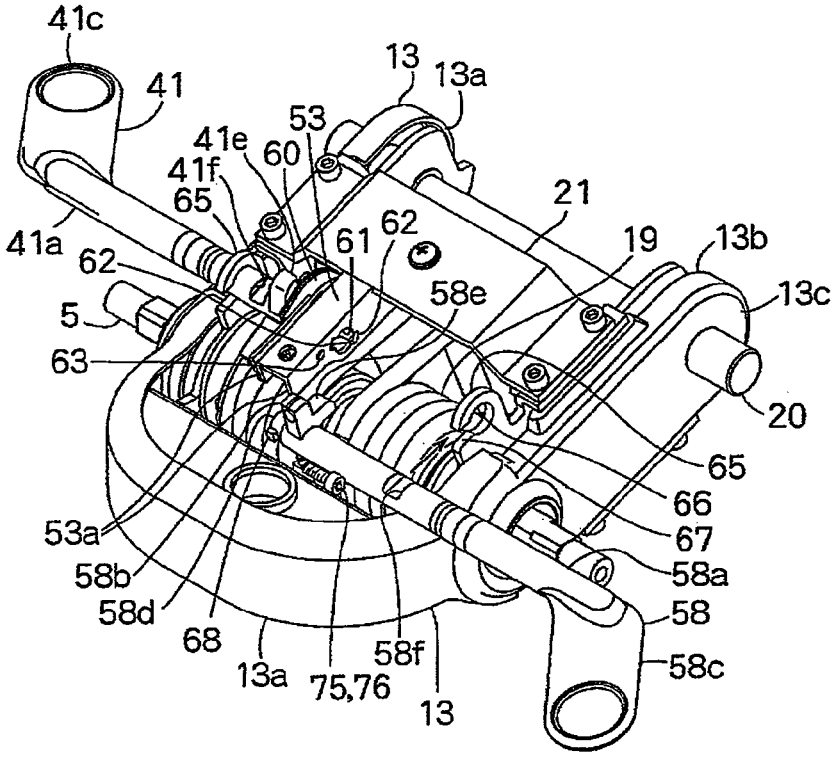
FIG. 11 is a rear exploded perspective view of the support base.
Figure 12:
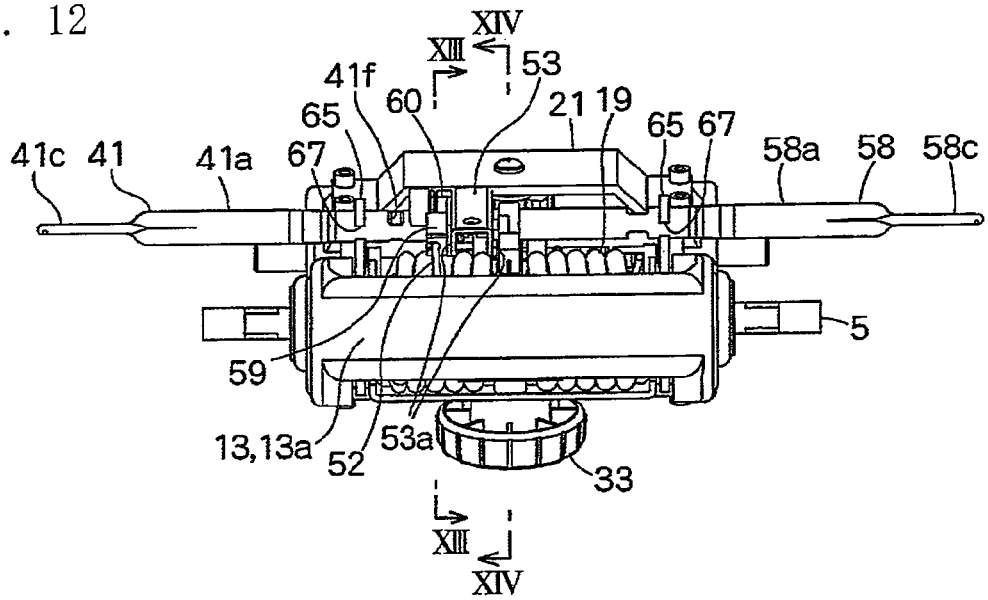
FIG. 12 is a rear elevational view thereof.
Figure 13:
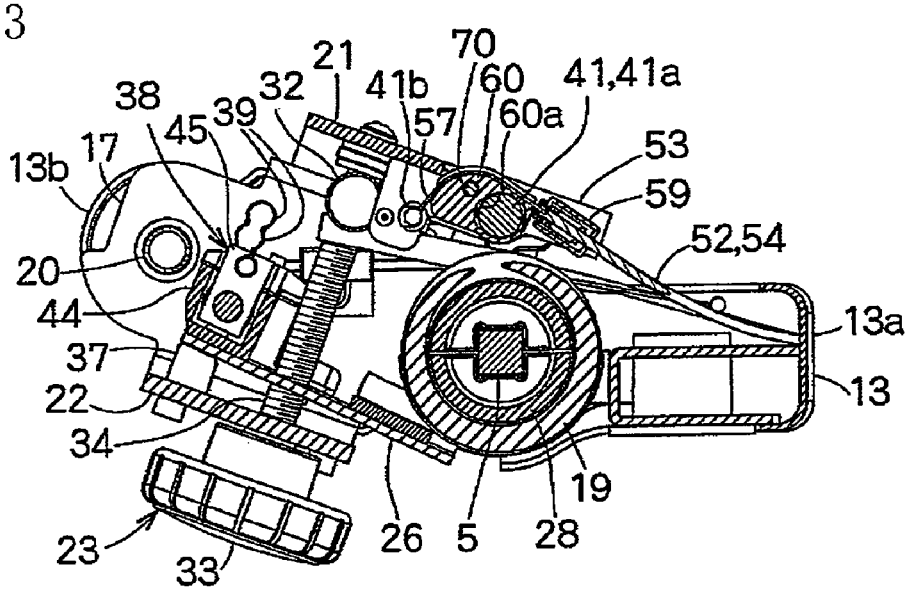
FIG. 13 a vertical sectional side view taken along the line XIII-XIII in FIG. 12.

In FIGS. 3 and 10, the operating lever 41 comprises a shaft 41*a* having an external diameter which is approximately equal to an internal diameter of the larger-diameter axial hole 66 to rotate smoothly therein without loosening; a first arm 41*b* which projects forward; an operating portion 41*c* which extends obliquely from the outer end of the operating shaft 41*a*; a smaller-diameter shaft 41*d* having an external diameter which is approximately equal to an internal diameter of the smaller-diameter axial hole 61 to rotate smoothly without loosening; and a second arm 41*e* which projects from the outer circumferential surface of the operating shaft 41*a* at almost right angles with respect to the first arm 41*b*.

The first arm 41 is connected to the locking device 38.

In FIG. 10, at part spaced by a distance D2 smaller than the distance D1 from the inner end of the operating shaft 41*a*, a pair of flat surfaces is formed to produce a thinner portion 41*f* having a distance W2 smaller than a distance W1 of the opening 67.

Projections 68,68 are provided on the outer circumferential surface of the smaller-diameter shaft 41 to fit in the recesses 62,62.

The thinner portion 41*f* of the operating shaft 41*a* passes through the opening 67 to allow the operating shaft 41*a* to be inserted in the larger-diameter axial hole 66. Then, the operating shaft 41*a* is moved inward and passed through the hole 60*a* of the wire guide 60 provisionally mounted on the side of the bearing member 53. While the projections 68,68 fits in the recesses 62,62, the smaller-diameter shaft 41*d* is inserted in the smaller-diameter axial hole 61 and the operating lever 41 is rotated at proper angles to allow the operating lever 41 to be mounted to the support base 4 easily and securely without screws.

The side plate 53*a* of the bearing member 53 is disposed between the end face of the operating shaft 41*a* and the projections 68,68 to allow the operating lever 41 mounted to the support base 4 to be rotatably supported with the side plate 53*a* and the bearing portion 65 stably and not to move axially.

Between the first arm 41*b* and the second arm 41*e*, a stopper pin 69 is bound to the side plate of the bearing member 53 with wire guide 60 with a screw 70 engaged in the threaded bore 63. Thus, the operating lever 41 can be turned between the locked position where the second arm 41*e* contacts the stopper pin 69 with the wire 57 pulled and the unlocking position where the first arm 41*b* contacts the stopper pin 69. The projection 68 does not fit in the recess 62 during the rotation from the locked position to the unlocking position.

During rotation of the operating lever 41, the projection 68 does not pass through the recess 62, or the operating lever 41 does not leave the support base 4.

The ends of the winding of the click or torsion spring 71 are in contact with the first arm 41*b* and the bearing member 53. When the operating lever 41 moves from an intermediate position toward the locked position, the operating lever 41 is urged toward the locked position by the click spring 71. When the operating lever 41 is moved toward the unlocking position, it is urged toward the unlocking position. Thus, the operating lever 41 is stably held between the locked position and the unlocking position.

As well as the operating lever 41, the operating lever 58 comprises an operating shaft 58*a* having an external diameter which is almost equal to an internal diameter of the larger-diameter axial hole 66; a first arm 58*b* projecting downward; an operating portion 58*c* which projects obliquely from the outer end of the operating shaft 58*a*; a smaller-diameter shaft 58*d* formed at the inner end of the operating shaft 58*a* and having an external diameter which is almost equal to the internal diameter of the smaller-diameter axial hole 61; and a second arm 58*e* which projects rearward from the outer circumferential surface of the operating shaft 58*a* perpendicular to the first arm 58*b*.

In the operating shaft 58*a* of the operating lever 58, there is formed a thinner portion 58*f* similar to the thinner portion 41*f* of the operating shaft 41*a* of the operating lever 41, and a third arm 58*g* which projects upward.

The operating lever 58 is attached to the left side plate 53*a* of the bearing member 53 and the left bearing portion 65 in the similar manner to the operating lever 41.

Figure 14:
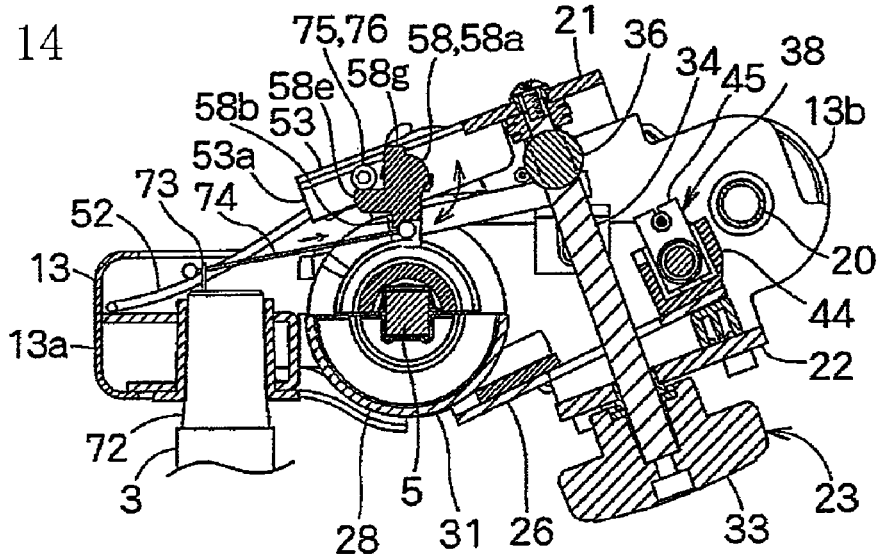
FIG. 14 is a vertical sectional side view taken along the line XIV-XIV in FIG. 12.

In FIG. 14, the end of the first arm 58*b* of the operating lever 58 is connected to an actuating portion 73 provided on a gas spring 72 and projecting from a base 13*a* of a support frame 13 via a wire 74. The operating lever 58 is rotated counterclockwise in FIG. 14, so that the wire 74 is pulled and the actuating portion 73 is tilted forward. Thus, the gas spring 72 gets free and is stretched by the force of the spring therein.

While the support base 4 is raised or lowered to a desired height, a hand leaves the operating lever 58, so that the actuating portion 73 is returned to an upright position by an internal returning spring force and the gas spring 72 is locked while it stretches.

With returning of the actuating portion 73 to the upright position, the operating lever 58 is returned to the original position.

In order that the stopper pin 75 may be positioned between the second arm 58*e* and the third arm 58*g*, the stopper pin 75 is fixed to the side plate 53*a* with the screw 75 which engages in the threaded bore 63, so that rotation of the operating lever 58 is limited within a range enough to pull the wire 74. Therefore, during rotation of the operating lever 58, the projection 68 does not pass through the recess 62 and the operating lever 58 does not fall off the support base 4.

As clarified from the above, in this embodiment, even if the spring-receiving member 26 is loaded by the weight of the occupant to cause the lock pin 40 not to move, the operating lever 41 is actuated to shift the wire end 42 as an actuating member between the pre-locking position and the pre-unlocking position. Thereafter, when the lock pin 40 is unloaded, the lock pin 40 is moved to the expected locked position or unlocking position by the force of the urging unit 43.

Therefore, it can be shifted while the occupant still sits, so that operativity is improved.

In this embodiment, the operating levers 41,58 can be attached to the support base 4 easily and securely with screws.

In addition, it is not necessary to use holding metal tools or screws, so that the number of parts can be reduced.

FIG. 15 shows the second embodiment of a locking device according to the present invention. The same numerals are allotted to the same members, and detailed description thereof is omitted.

To a slider 45 which is attached to a case 44 to slide in the same direction as that of the lock pin 40, the end of an outer tube 54 of a Bowden cable 52 is mounted. A wire end 42 is mounted to the end of a retractable wire 57 which extends leftward from the end of the outer tube 54. The wire end 42 is mounted to a bracket 78 fixed to the right end of the lock pin 40 with a screw 77. There is a shorter distance between the end of the outer tube 54 and the wire end 42 in FIGS. 15A and 15D which is called an pre-unlocking condition; and a longer distance therebetween in FIGS. 15B and 15C which is called a pre-locking condition.

The first urging unit in an urging unit 43 is a compression spring 79 between a bracket 78 and the slider 45, and the second urging unit in the urging unit 43 is a coil spring 80 mounted to the slider 45 and the case 44 to pull the slider 45 rightward. In the pre-locking state as shown in FIGS. 15B and 15C, the lock pin 40 is urged toward a locked position by a compression spring, and in the pre-unlocking state in FIGS. 15B and 15C, the compression spring 79 is compressed, so that the bracket 78 and the slider 45 is held to contact each other or to be close to each other. The lock pin 40 is urged toward the unlocking position by the coil spring 80.

Figure 15A:
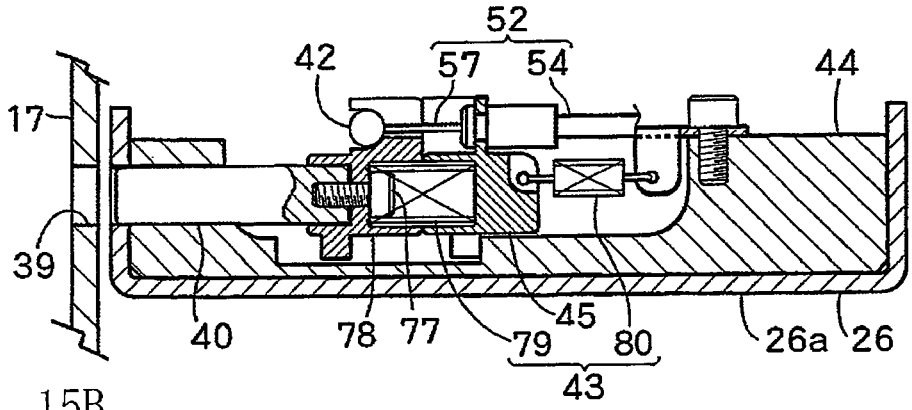
FIGS. 15A-15D are views showing different states of the second embodiment of a locking device according to the present invention.
Figure 15B:
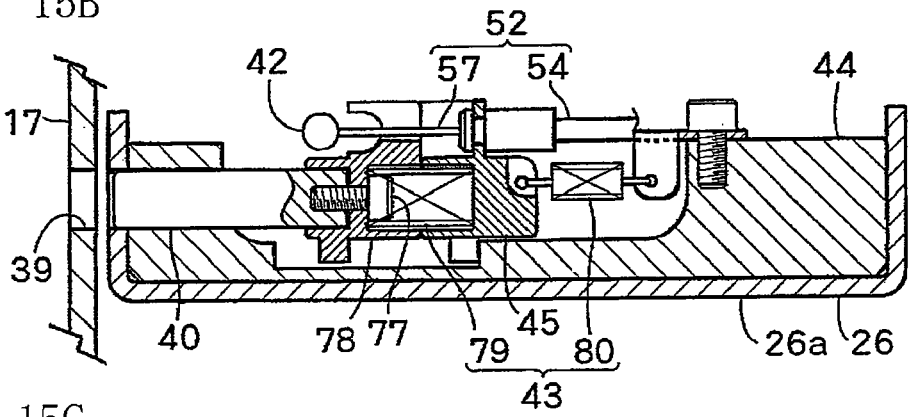
Figure 15C:
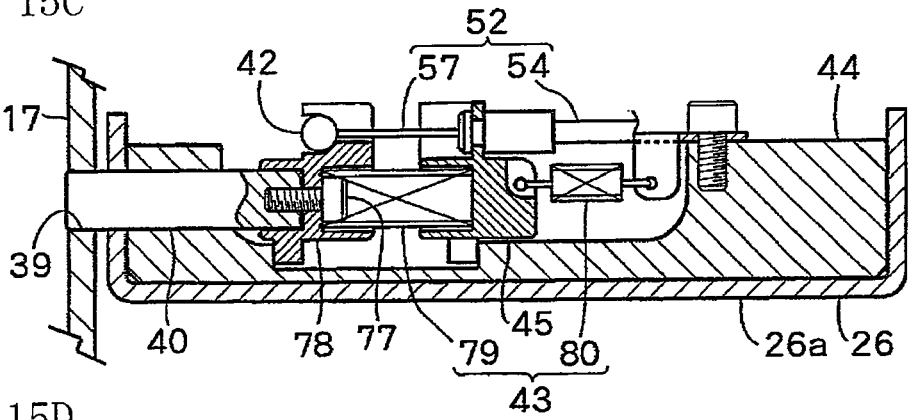
Figure 15D:
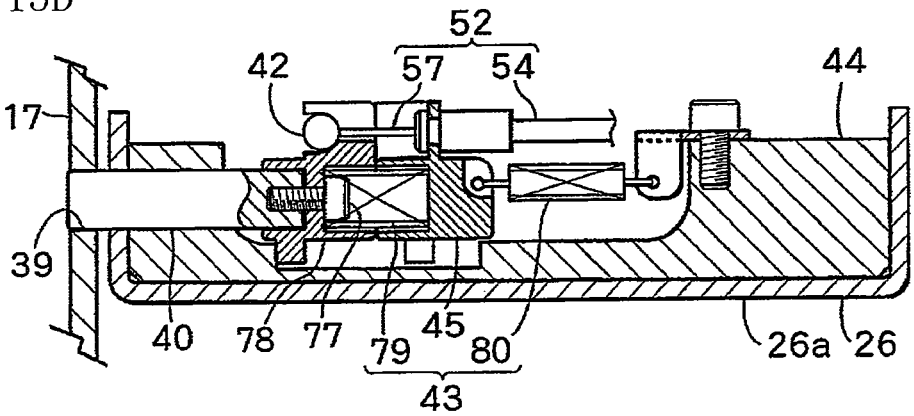

FIGS. 15A-15D are corresponding to FIGS. 9A-9D. FIG. 15A shows the unlocking state. FIG. 15B shows the pre-locking state. FIG. 15C shows the locked state. FIG. 15D shows the pre-unlocking state.

As clearly shown in the figures, the second embodiment achieves similar advantages.

The present invention is not limited to the foregoing embodiments. Various variations may be made without departing from the scope of claims.

For example, in the foregoing embodiments, the support member is the reinforcing plate 17 in the support base 4, and the movable member is the spring-receiving member 26. But the support member may be the support base 4, and the movable member may be the front rod portion 8*a*. The locking device according to the present invention may be provided between all the movable members of the chair and the support member for supporting it movably.

In the first embodiment, the support member is the support base 4 provided at the upper end of the column to support the seat 9 and the backrest 7. The movable member is a pivoting member which is the spring-receiving member 26 pivotally mounted to the support base 4 to rotate together with a pair of support links 10,6 supporting the seat 9, and the lock pin 40 is selectively engaged in a plurality of engagement holes 39. It may be considered that the seat 9 is locked at a tilting angle corresponding to the engagement hole 39.

The urging unit 43 may comprise a single coil spring one end of which is mounted to the wire end 42, the other end being mounted to the lock pin 40.

The present invention is not limited to the foregoing embodiments, and various modifications may be made without departing from the scope of claims.

For example, the operating levers 41,58 may be mounted to the lower surface of the seat 9 as support member and the front portion 8*a* of the backrest frame 8 by similar way to the above.

What is claimed is:

1. A locking device for a movable member in a chair, comprising:

a support member comprising a support base on an upper end of a column of the chair to support a seat and a backrest of the chair;

a shaft, the movable member comprising a pivoting member for turning around the shaft together with the backrest pivotally mounted to the support base with the shaft;

the movable member is mounted to the support member to move in one direction, a plurality of engagement holes being formed in the support member;

a lock pin provided on the movable member to selectively engage in one or more of the plurality of engagement holes in a locked position and to disengage from the one or more of the plurality of engagement holes in an unlocking position to lock the backrest at a tilting angle;

an operating member;

an actuating member moved by the operating member between a pre-locking position and a pre-unlocking position;

an urging unit comprising a first compression spring for urging the lock pin toward the locked position when the actuating member is in the pre-locking position, and a second compression spring for urging the lock pin toward the unlocking position when the actuating member is in the pre-unlocking position;

a torsion spring for urging the backrest to return to an upright position, the pivoting member comprising a spring-receiving member receiving the torsion spring;

a Bowden cable which comprises an outer tube including a wire, the actuating member comprising a wire end of the wire, the operating member is operable for actuating the wire end and the operating member comprises an operating lever pivotally mounted to the support base, another end of the wire being coupled to the operating lever; and the lock pin slides through a slider, the first compression spring and the second compression spring being in an elongate groove formed in the spring-receiving member, the slider having a hole in which the wire end engages, the wire end operated by the operating lever moving the lock pin via the slider to engage in the one or more of the plurality of engagement holes in the locked position.

2. A locking device for a movable member in a chair, comprising:

a support member comprising a support base on an upper end of a column of the chair to support a seat and a backrest of the chair;

a shaft the movable member comprising a pivoting member for turning around the shaft together with the backrest pivotally mounted to the support base with the shaft;

the movable member is mounted to the support member to move in one direction, a plurality of engagement holes being formed in the support member;

a lock pin provided on the movable member to selectively engage in one or more of the plurality of engagement holes in a locked position and to disengage from the one or more of the plurality of engagement holes in an unlocking position to lock the backrest at a tilting angle;

an operating member;

an actuating member moved by the operating member between a pre-locking position and a pre-unlocking position;

an urging unit comprising a first compression spring for urging the lock pin toward the locked position when the actuating member is in the pre-locking position, and a second compression spring for urging the lock pin toward the unlocking position when the actuating member is in the pre-unlocking position;

a torsion spring for urging the backrest to return to an upright position, the pivoting member comprising a spring-receiving member receiving the torsion spring;

a Bowden cable which comprises an outer tube including a wire, the actuating member comprising a wire end of the wire, the operating member is operable for actuating the wire end and the operating member comprises an operating lever pivotally mounted to the support base, another end of the wire being coupled to the operating lever; and the support base comprises a bearing member having a smaller-diameter axial hole having a recess, and a bearing portion which has a larger-diameter axial hole larger in diameter than the smaller-diameter axial hole, the larger-diameter axial hole having an opening, both of the larger-diameter axial hole and the smaller-diameter axial holes being axially aligned with each other and spaced from each other, an external diameter of an operating shaft of the operating lever being almost equal in diameter to the larger-diameter axial hole, a smaller-diameter shaft being formed on the end of the operating shaft, a thinner portion smaller than the opening being formed on the operating shaft, a projection being formed on the outer circumferential surface of the smaller-diameter shaft to fit in the recess, the bearing portion which has the smaller-diameter axial hole being held between the end face of the operating shaft and the projection to bear the smaller-diameter shaft with the smaller-diameter axial hole, the operating shaft being borne by the larger-diameter axial hole.

* * * * *